US005950511A

United States Patent [19]

Lüthi

[11] Patent Number: 5,950,511

[45] Date of Patent: Sep. 14, 1999

[54] PROCESS AND DEVICE FOR HANDLING PRINTED PRODUCTS

[75] Inventor: Ernst Lüthi, Brittnau, Switzerland

[73] Assignee: Grapha-Holding AG, Hergiswil, Switzerland

[21] Appl. No.: 08/765,051

[22] PCT Filed: Apr. 24, 1996

[86] PCT No.: PCT/CH96/00147

§ 371 Date: Jan. 2, 1997

§ 102(e) Date: Jan. 2, 1997

[87] PCT Pub. No.: WO96/34724

PCT Pub. Date: Nov. 7, 1996

[30] Foreign Application Priority Data

May 2, 1995 [CH] Switzerland ..... 01244/95

[51] Int. Cl.[6] ..... B26D 1/56; B65H 5/08

[52] U.S. Cl. ..... 83/37; 83/39; 83/154; 83/343; 83/404.1; 83/409.1; 83/418; 83/934

[58] Field of Search ..... 83/37, 404.1, 409.1, 83/409.2, 415, 934, 23, 39, 154, 343, 404, 418

[56] References Cited

U.S. PATENT DOCUMENTS

| | | | |
|---|---|---|---|
| 2,245,868 | 6/1941 | Melby | 83/409.1 |
| 4,095,391 | 6/1978 | Anguiano | 83/409.2 X |
| 5,113,731 | 5/1992 | Reist | 83/934 X |
| 5,125,304 | 6/1992 | Petersen | 83/934 X |
| 5,501,127 | 3/1996 | Stauber | 83/934 X |
| 5,503,051 | 4/1996 | Stauber | 83/934 X |

FOREIGN PATENT DOCUMENTS

| | | |
|---|---|---|
| 668216 | 12/1988 | Switzerland . |

*Primary Examiner*—Eugenia A. Jones

*Attorney, Agent, or Firm*—Venable; George H. Spencer; Ashley J. Wells

[57] ABSTRACT

The invention concerns a method and an arrangement for handling printed products by making an edge cut with the aid of a cutter. The printed products in this case are supplied to the cutter by grippers that circulate along a first conveying loop, and the edge area to be cut on the printed products positioned in the grippers is stabilized by clamping braces that can be placed against the printed products in the range of the cutter. After the edge cut is made, the printed products with the grippers are disengaged from the clamping braces and discharged.

27 Claims, 2 Drawing Sheets

PROCESS AND DEVICE FOR HANDLING PRINTED PRODUCTS

BACKGROUND OF THE INVENTION

1. Field of the Invention

The invention concerns a method for handling printed products by making an edge cut with the aid of a cutter, for which the printed products are fed to grippers that circulate with a first conveying loop and are spaced apart by maintaining a mutual distance, and which pick up the printed products by one edge and carry them along the first conveying loop, as well as an arrangement that can be used for implementing this method.

2. Description of the Related Art

With known methods of this type, as described for example in the CH-PS-668 216, the printed products are released for making the cut from the grippers circulating with the first conveying loop and are thus thrown from above into hoppers that are open on the top and are fixed to an endlessly circulating, driven traction element. They are subsequently moved perpendicular to the drive direction inside the hoppers so that the edges can be cut, whereupon the thus aligned printed products are cut by cutting blades that are installed fixedly and are coordinated in pairs on a second endlessly circulating, driven traction element, for which one of the belts runs parallel to a segment of the first traction element. The printed products are subsequently gripped by the grippers of a discharge conveyor that circulate at a mutual distance to each other and are thus taken from the hoppers and discharged.

In order to ensure a reliable operation of an arrangement used for implementing such a method, the conveying speeds of the feed conveyor and the discharge conveyor must be matched exactly to the circulating speed of the hoppers. Furthermore, it is necessary to exactly match the rotation of the coordinated pairs of cutting blades to the rotation of the hoppers. In particular, the rotation of the cutting blades and that of the hoppers must be synchronized precisely not only with respect to the circulating speed, but also with respect to the circulating phase, because an insufficient phasing can already result in a displacement of the printed products in the hoppers that obstructs the further operation if one of the paired, coordinated cutting blades starts cutting the printed product too early, that is before the respective counter blade has been placed against it.

In view of the above described problems with the Prior Art, it is the object of the invention to make available a method for handling printed products that permits making a reliable edge cut as well as an arrangement for implementing such a method.

SUMMARY OF THE INVENTION

From a procedural point of view, the solution to this problem is that the printed products are moved by the grippers to a second conveying loop that is running in the same direction as the first conveying loop along a joint movement path and which has clamping braces arranged at the same spacing as the grippers, wherein the clamping braces during the course of the joint movement path are used to make a stabilizing contact with the free edges of the printed product held by the grippers of the first conveying loop and that in this position, the edge cut is made by the blade on the free edge areas of the printed products that project over the clamping braces toward the cutter, installed immovably along the joint movement path and that the cut printed products subsequently leave the joint movement path while held by the grippers along the first conveying loop.

With these methods, the coordination between the printed products and the grippers that supply them continues to exist during and after the edge cut is made, so that a transfer from or to a gripper conveyor it is not necessary either for supplying the printed products to the cutter or for removing the printed products after the edge cut has been made. Thus, when using the method according to the invention, it is not necessary to match the conveying speeds of different conveying means to ensure the reliability of such transfers, as is necessary when using the known methods.

By means of the stabilizing intervention of the clamping braces with the free edge areas to be cut of the printed products positioned in the grippers of the first conveying loop, it is furthermore possible to prevent an undesired displacement of the printed products while the edge cutting takes place, even if a blade of the cutter is placed too early against the printed product. Such an error then only results in an edge cut that differs from the desired cut, but generally is still within permissible tolerances. Such deviations from the edge cut normally do not represent an obstacle to further processing of the printed products. That is why the stabilization of the printed products with the clamping braces helps increase reliability considerably for handling the printed products during and after the cutting of the edge.

Finally, when implementing the method according to the invention, the feeding and discharge of the printed products occurs by means of grippers that circulate along one single gripper transporter, while two gripper transporters must be used with the above-described method for feeding and removing, which must also be exactly synchronized with each other, at least with respect to the conveying speed. This contributes to further to increasing the operational reliability when implementing the method according to the invention.

An arrangement that can be used for implementing the method according to the invention for handling printed products and making an edge cut, essentially distinguishes itself by a number of clamping braces that are arranged at the same intervals as the grippers and circulate along a second conveying loop, synchronized with the first conveying loop along a common movement path, into which the printed products can be inserted by the grippers during the course of the common movement path, with which the printed product edge areas that are not cut and are positioned in the grippers can be stabilized, as well as that the cutter for performing the edge cut is fixed in position at the common movement path so that the edge cut can be made at the free edge areas of the printed products that project over the clamping braces toward the cutter, and that subsequent to the common movement path, the printed products can be discharged while still in the grippers along the first conveying loop.

The printed products in the grippers are aligned comparatively roughly for the feeding. Furthermore, the grippers of a standard gripper transporter and thus also the printed products that are carried along, are normally subjected to considerable vibrations or even deflections. In order to ensure an exact edge cut, it is therefore advisable that the grippers be relieved of the printed products during the course of the common movement path and are not attached to the printed products until after the edge cut has been made.

For that purpose, the grippers of the arrangement according to the invention can be adjusted from a closed to a release position during the course of the common movement path.

Following the release of the grippers, the printed products can be held by the respective clamping brace only, without having to give up the assignment to the feeding gripper. Since the clamping braces are needed only during the course of the comparatively short common movement path, the second conveying loop can be designed considerably shorter than the first conveying loop. This permits a vibration- and deflection-free guidance of the clamping braces along the second conveying loop with a reasonable structural expenditure. The use of the clamping braces therefore opens up a cost-effective option for making an exact edge cut.

In order to improve the only rough orientation of the printed products positioned in the grippers, it is planned to displace the printed products after they are released by the grippers so that they can be aligned in an edge cutting position, perpendicular to the conveying direction.

It is useful if the clamping braces and the second conveying loop are designed for this in such a way that the printed products are positioned during the displacement on one jaw of the clamping braces and are stabilized only after the displacement, perpendicular to the conveying direction, by attaching another jaw of the clamping brace. It is useful if the clamping braces of the arrangement according to the invention can be adjusted between a clamped-in position and an opened position and have one each clamping jaw onto which the printed products can be placed in the opened position, during the course of the common movement path and on which the printed products can be displaced perpendicular to the conveying direction by means of an alignment device, as well as another clamping jaw, which can be attached to stabilize the printed products and for adjusting the clamping braces to the clamping position.

In order to adjust the clamping braces to different printed product formats, it can be provided that at least one of its clamping jaws has at least two clamping jaw parts that can be displaced against each other perpendicular to the conveying direction.

For the displacement, the printed products can be placed along the common movement path so that they drag along a guide rail. This placement such that they drag, however, can lead to damage to the printed products. It is therefore especially advantageous if for the displacement at least along a segment of the common movement path, slides that move along with the printed products are placed against the free edge areas of the printed products. With the side facing away from the printed products, for example, these slides can fit closely against guide rails via thereon rotatably attached rollers and can thus be displaced perpendicular to the conveying direction.

In general, the second conveying loop can have any optional form and can, for example, be designed circular.

However, it is particularly advantageous if the second conveying loop has two straight segments that run parallel to each other and are connected by semicircular loop segments. If the common movement path for such an embodiment of the second conveying loop runs at least in part along a portion of the straight segments, at least one edge cutting can occur during the course of this straight segment.

Since the free edge areas that are stabilized with the clamping braces and project toward the cutter move along the straight segment with an unhurried, uniform movement, it is thereby possible to achieve an increased reliability when making the edge cut. Furthermore, it is simple to extend the common movement path without reducing the vibration and fluctuation stability of the clamping braces through this course of the second conveying loop. This opens up the possibility of successively arranging several cutters along the common movement path in a space-saving way.

In order to realize this preferred course for the second conveying loop, the clamping braces are advantageously fixed on a traction member that circulates along the second conveying loop and is controlled via a driving roller and a deflection roller arranged at a distance to it.

In order to reduce the floor space required for the arrangement used to implement the method according to the invention, the parallel-running straight segments are advisably arranged one above the other. It is particularly easy to align the printed products deposited on a clamping jaw of the clamping braces if the printed products traverse through one of the semicircular loop segments after being inserted into the clamping braces and before the edge cut is made. During the course of this semi-circular loop segment, the printed products are placed on one clamping jaw of the clamping braces after the grippers are released and can be aligned easily once the clamping braces are set to the open position. In order to realize the above described course for the second conveying loop, the driving roller and the deflection roller according to the invention preferably have roller axes positioned in a horizontal plane.

It is advisable if the edge cut is made along the lower straight segment, on the printed products conveyed there below the grippers. The waste products from cutting then can drop down without falling on the grippers or the clamping braces and can be discharged. This also contributes to the operational reliability of the method according to the invention.

The free edge areas of the printed products that are stabilized with the clamping braces can be cut by using a cutter that utilizes only one blade for making the edge cut, particularly when cutting thin printed products. However, in order to absorb the cutting pressure and to increase the accuracy when making an edge cut, it is particularly advantageous if the cutter has at least one blade and at least one therewith cooperating counterblade, wherein during the course of the common movement path, the counterblade can be fitted against a rear side of the free edge area that projects toward the cutter and the blade for making the edge cut acts upon the front of it.

The blade in this case is advisably moved in a direction counter to the conveying direction.

For placing it against successively supplied free edge areas that are stabilized with the clamping braces, the counterblade advisably should be driven by a rotating axis that runs perpendicular to the conveying direction. The blade movement in the direction counter to the conveying direction of the printed products is particularly simple if the blade for rotating around the rotating axis can be driven in a direction that is counter to the rotational direction of the counterblade.

Although the method according to the invention can be implemented using only one counterblade and only one blade, the operating speed can be increased by avoiding an undesirably high wear of the cutter if the cutter has several counterblades and/or blades that rotate with the respective spacing of the grippers around the rotating axis.

As already addressed in connection with the preferred arrangement of the second conveying loop, it is planned to arrange a corresponding number of cutters along the common movement path for cutting several projecting edge areas of a printed product that are stabilized with the clamping braces.

BRIEF DESCRIPTION OF THE DRAWINGS

The invention is explained in the following by referring to the drawing, to which we want to point expressly with respect to all details that are essential to the invention and are not explained further in the description.

The drawing shows.

DESCRIPTION OF THE PREFERRED EMBODIMENTS

Figure 1:
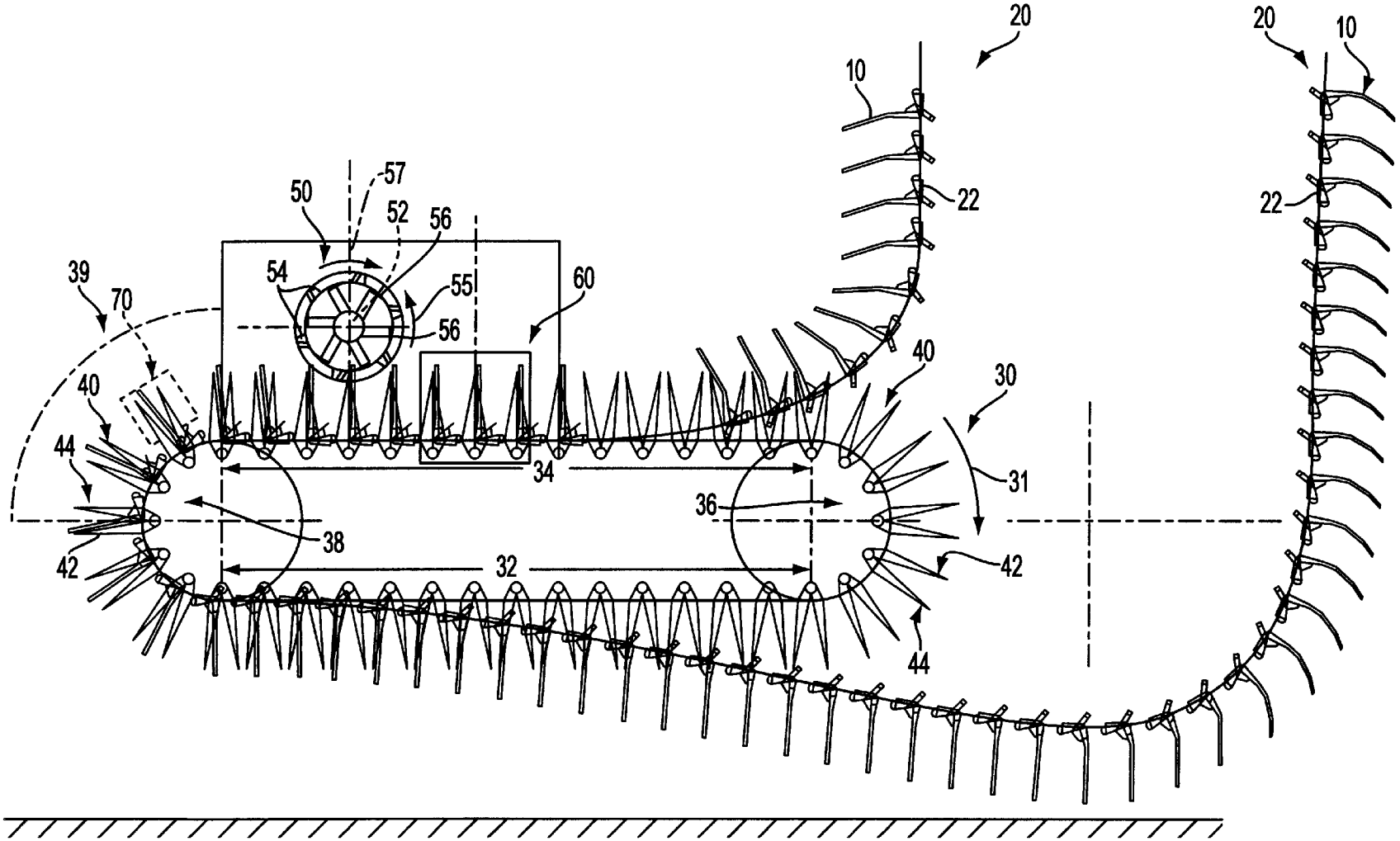
FIG. 1 A view from the side of an arrangement according to the invention.

With the arrangement shown in FIG. 1, printed products 10 are transported along the first conveying loop 20 with grippers 22 that circulate along a first conveying loop 20, spaced at a distance to each other. The grippers 22 here grip the back of the printed products 10.

Over the course of the first conveying loop 20, the printed products 10 that are transported by the grippers 22 are inserted into clamping braces 40 that circulate with the same spacing as the grippers along a second conveying loop 30. The second conveying loop 30 has two straight segments 32 and 34 that are arranged one above the other, and which are connected via semicircular segments 36 and 38. The clamping braces 40 are driven in the range of the semicircular segment 36 by means of a driving roller in the direction indicated by the arrow 31 and are fixed in place in the range of the semicircular segment 38 by means of a deflection roller.

The clamping braces 40 are placed into an opened position in the range of the lower straight segment 32 for feeding the printed products 10 that are conveyed with the grippers 22 along the first conveying loop 20. In this opened position, the printed products 10, together with the grippers 22, can be inserted between a first clamping jaw 42 and a second clamping jaw 44 of the clamping braces 40.

Following the engaging at the end of the lower straight segment 32, the clamping braces 30 are conveyed along a common movement path that runs along semicircular segment 38 and a portion of the upper straight segment 34 of the second conveying loop 30 such that they are synchronized with the grippers 22. In the upper range of the semicircular segment 38, the printed products 10 positioned in the grippers 22 rest on the clamping jaw 42 of the clamping brace 40.

After adjusting the grippers 22 to a release position during the course of the upper range 39 of the semicircular segment 38, the printed products 10 resting on the clamping jaw 42 are displaced perpendicular to the conveying direction 31 by means of a conventional alignment device 70 (shown schematically in FIG. 1), for example, a slide that acts upon their edges for aligning them in an edge cutting position, which permits a more exact edge cut.

Following the alignment, the second clamping jaw 44 is clamped to the printed products 10 during the course of the upper straight segment 34 in order to stabilize the edge to be cut. Following this adjustment of the clamping braces 40 to a clamping position, the edge area to be cut of the printed products 10 projects over the clamping brace 40. The edge cut can then be made in this position. The grippers 22 here can remain in the release position.

The example of cutting the front of the printed products is used to explain how the edge cut is made. To do this, a cutter 50 is fixedly arranged at the common movement path, toward which the front of printed products 10 projects over the clamping braces 40. The cutter 50 has a number of counterblades 54 that circulate in a direction indicated by the arrow 55 around a circulating axis 52, which is perpendicular to the conveying direction 31. The counterblades 54 are arranged along the circular path at the same spacing as the grippers 22 or the clamping braces 40. The circulating speed of the counterblades 54 corresponds to the conveying speed of the grippers 22 or the clamping braces 40. Over the course of the circular path, the counterblades 54 are placed against the rear, as seen in conveying direction, of the front of the printed products 10 stabilized with the clamping braces 40.

To perform an edge cut, the cutter 50 furthermore comprises a number of blades 56 that circulate around the circulating axis 52 in a direction indicated by the arrow 57. The blades 56 are also arranged along the circular path with the same spacing as the grippers 22 or the clamping braces 40. The blades 56 that act upon the frontal portion of the front for printed products 10 are also driven with a circulating speed that corresponds to the conveying speed of the grippers 22 or the clamping braces 40. This ensures that a specific counterblade 54 always cooperates with the same blade 56 for making continuous cuts on the edges of printed products 10, which are successively conveyed toward the cutter 50.

In a similar way, the edge cut is made on the top and bottom area of the printed products 10 by means of a cutter 60 that is fixed in place in downstream direction along the straight segment 34. After leaving the cutter 60, the clamping braces 40 are changed to the opened position. The grippers 22 are simultaneously changed to the closed position for a renewed gripping of the backs of the printed products 10, and the printed products 10 that are now carried along once more by the grippers 22 leave the common movement path along the first conveying loop.

Figure 2A:
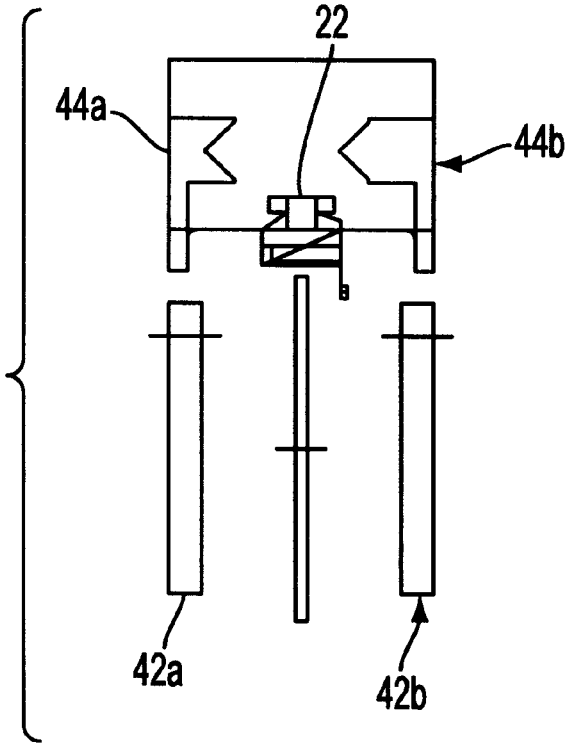
FIG. 2*a* A view of a clamping brace for the arrangement shown in FIG. 1, in a first position and FIG. 2*b* A view of the clamping brace shown in FIG. 2*a* in a second position.
Figure 2B:
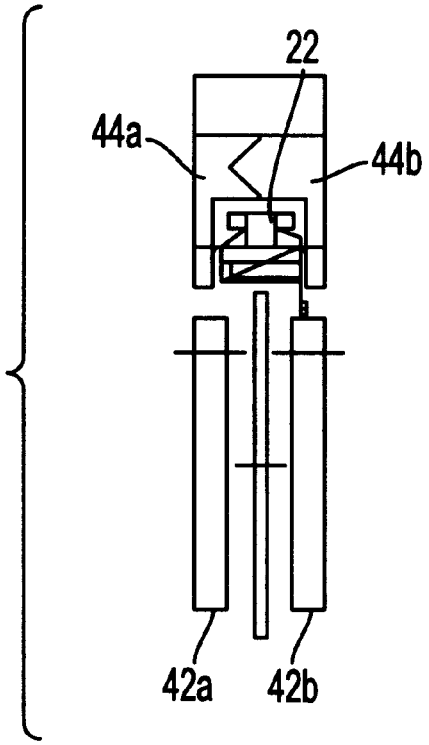

As can be seen in FIG. 2, the clamping jaws 42 and 44 of clamping braces 40 are designed in two parts. The area between the clamping jaw parts 44*a* and 44*b* here serves to accept the gripper 22 along the common movement path. As can be seen when comparing the FIGS. 2*a* and 2*b*, the clamping jaw parts 44*a* and 44*b* as well as 42*a* and 42*b* can be displaced against each other, perpendicular to the conveying direction. This permits adjusting the clamping braces 40 to different printed product formats. For the position shown in FIG. 2*a*, the outside edges of the clamping jaw parts 44*a* and 44*b*, for example, are at a distance of 400 mm, while for the position shown in FIG. 2*b*, they are at a distance of only 200 mm from each other.

The invention is not limited to the exemplary embodiment explained with the aid of the drawing. For example, the edge cut can be made along the lower straight segment 32 as well if the printed products are inserted into the clamping braces 40 along the upper straight segment 34 or the semicircular segment 36. This achieves that the cutting waste covers neither the grippers 22 nor the clamping braces 40. Consequently, making the edge cut on printed products that are hanging below the grippers 22 or the clamping brace 40 leads to further operating reliability of the arrangement according to the invention. Furthermore, it is also planned to align the printed products prior to making the edge cut with the aid of connecting members that can be placed against the printed products.

What is claimed is:

1. A method for handling printed products to make edge cuts thereto with a cutter, comprising:

providing a first conveying loop which circulates and which includes a plurality of grippers which are spaced apart by a preselected spacing to maintain a mutual distance there between;

providing a second conveying loop which circulates and is synchronized with the first conveying loop along a common movement path, and which includes a plurality of clamping braces which are spaced apart by a preselected spacing to maintain a mutual distance there between, the preselected spacing between respective clamping braces of the plurality of clamping braces being the same as that between respective grippers of the plurality of grippers;

providing a cutter arranged fixedly at the common movement path and in alignment with a free edge area of the respective printed products to be cut;

feeding the printed products to respective grippers of the plurality of grippers which pick up the respective printed products by one edge thereof;

carrying the printed products by the respective grippers along the common movement path with the first conveying loop;

feeding the printed products into respective clamping braces so that the respective clamping braces, during the course of movement along the common movement path, are brought into stabilizing contact with respective free edge areas of the printed products to be cut, which respective free edge areas are positioned in the respective grippers of the first conveying loop and have a portion which projects over the respective clamping braces toward the cutter; and cutting the respective free edge areas of the printed products with the cutter to provide at least one edge cut for each printed product and to provide respective cut printed products.

2. The method according to claim 1, further comprising, prior to the cutting, releasing respective grippers, during the course of movement along the common movement path, from the respective printed products positioned therein and placing the respective grippers back on the respective printed products only after respective edge cuts are made.

3. The method according to claim 2, wherein, following the releasing the respective printed products from the respective grippers, the method further comprises displacing the printed products in a direction perpendicular to the conveying direction for aligning the respective printed products in a position for edge cutting.

4. The method according to claim 3, wherein each clamping brace of the plurality of clamping braces has a pair of clamping jaws, and wherein the displacing is accomplished by positioning one respective printed product on one jaw of each respective pair of clamping jaws;

aligning the respective printed product after positioning; and stabilizing the respective printed product following alignment by clamping another jaw of each respective pair of clamping jaws in place thereon.

5. The method according to claim 3, wherein the displacing of respective printed products along the common movement path is accomplished by providing an alignment device placed against the edge area of the respective printed product that is opposite the free edge area to be cut.

6. The method according to claim 1, wherein the second conveying loop has two straight segments that are connected by semicircular loop segments and run parallel to each other, wherein the common movement path runs at least in part along a portion of the two straight segments, and wherein the cutting includes making at least one edge cut to respective printed products during the course of movement thereof along the portion of the two straight segments of the second conveying loop.

7. The method according to claim 6, wherein the two straight segments of the second conveying loop are arranged one above the other so that an upper straight segment and a lower straight segment are provided.

8. The method according to claim 7, wherein the printed products conveyed along the lower straight segment are conveyed in a position below the respective grippers, and wherein the cutting includes making at least one edge cut to respective printed products during movement along the lower straight segment.

9. The method according to claim 7, wherein, after inserting the respective printed product into the respective clamping brace and prior to making the respective edge cut therein, the respective printed product passes through one of the semicircular loop segments.

10. The method according to claim 9, further comprising aligning the respective printed products during the course of movement through said one of the semicircular loop segments.

11. The method according to claim 1, wherein the cutter includes a blade and a counterblade which cooperate with one another, wherein the respective free edge areas of the printed products project beyond the respective clamping braces and have front and rear projecting surfaces with respect to the direction of the common movement path, wherein the counterblade is placed against the respective rear projecting surfaces of the printed products for making the edge cut, and wherein the blade that cooperates with the counterblade acts upon the respective front projecting surfaces of the printed products in order to make the edge cut.

12. The method according to claim 11, wherein the blade is moved in a direction counter to that of the common movement path.

13. The method according to claim 12, wherein the counterblade circulates around an axis that is perpendicular to the direction of the common movement path.

14. The method according to claim 13, wherein the blade circulates around the axis in a circulating direction that is counter to that of the counterblade.

15. The method according to claims 11, wherein a plurality of cutters is provided, and wherein a plurality of edge cuts are made in each respective free edge area of the printed products that projects over the respective clamping brace toward the respective cutters.

16. An arrangement for handling printed products for making edge cuts therein, comprising:

a first conveyor having a plurality of grippers which circulate around a first conveying loop, which are spaced apart at a mutual distance, and which grip respective ones of the printed products, respectively, by one edge thereof and move the respective printed products along the first conveying loop;

a second conveyor which moves along a common movement path and in synchronisity with the first conveying loop, and which has a plurality of clamping braces which circulate on a second conveying loop, which are spaced apart at a mutual distance from one another and have the same mutual distance as that of the plurality of grippers, and into which the respective printed products are inserted during movement along the common movement path by the plurality of grippers, and which stabilize respective free edge areas of the respective printed products to be cut;

a cutter for cutting at least one edge cut at the respective free edge areas of respective printed products that project over the respective clamping braces toward the cutter, and which is arranged fixedly at the common movement path; and an alignment device for perpendicular displacement of the respective printed products, wherein the plurality of clamping braces are adjustable between an opened position and a clamping position, and wherein each clamping brace has a pair of clamping jaws including one clamping jaw onto which one respective printed product is placed in the opened position during movement along the common movement path so that the respective printed products are displaceable in a direction perpendicular to the direction of the common movement path by means of the alignment device, and another clamping jaw clampable onto the respective printed product after alignment by the alignment device for clamping and for stabilizing the respective printed product.

17. The arrangement according to claim 16, wherein at least one of the pair of clamping jaws has at least two clamping jaw parts that are displaced against each other in a direction perpendicular to the direction of the common movement path.

18. The arrangement according to claim 16, wherein the alignment device moves with the respective printed products in the direction of the common movement path and is placed against and in contact with the respective free edge areas of the respective printed products.

19. The arrangement according to claim 16, further comprising a traction member circulating along the second conveying loop onto which the plurality of clamping braces are fixed in place.

20. The arrangement according to claim 19, further comprising a driving roller for driving the traction member and a deflection roller arranged at a distance from the driving roller, and wherein the traction member is guided over the driving roller and the deflection roller.

21. The arrangement according to claim 20, wherein the driving roller and the deflection roller have respective roller axes that are both positioned in a joint horizontal plane.

22. The arrangement according to claim 20, wherein the respective printed products are aligned proximate to at least one of the driving and the deflection roller.

23. The arrangement according to claim 16, wherein the cutter comprises at least one blade and at least one counterblade which cooperate with one another to make respective edge cuts, wherein the respective free edge areas of the printed products project beyond the respective clamping braces toward the cutter and have front and rear projecting surfaces with respect to the direction of the common movement path, wherein the counterblade is placed against rear projecting surfaces of the printed products for making the respective edge cuts, and wherein the blade that cooperates with the counterblade acts upon the respective front projecting surfaces of the printed products in order to make the respective edge cuts.

24. The arrangement according to claim 23, further comprising driving means to circulate the counterblade around a circulating axis that runs in a circulation direction that is perpendicular to the movement along the common movement path.

25. The arrangement according to claim 24, further comprising driving means to circulate the blade around the circulating axis in a direction that is counter to that of the the counterblade.

26. The arrangement according to claim 24, wherein the cutter has a rotating axis and comprises a plurality of counterblades and blades that each circulate around the rotating axis at a spacing which is the same spacing as that of the plurality of grippers.

27. The arrangement according to claim 16, further comprising a plurality of cutters arranged along the common movement path, and wherein several edge areas of respective printed products which project over the respective clamping braces are cut by a corresponding number of cutters.

* * * * *